US005095507A

United States Patent [19]

Lowe

[11] Patent Number: 5,095,507

[45] Date of Patent: Mar. 10, 1992

[54] METHOD AND APPARATUS FOR GENERATING INCOHERENT MULTIPLES OF A MONAURAL INPUT SIGNAL FOR SOUND IMAGE PLACEMENT

[76] Inventor: Danny D. Lowe, c/o O Sound Ltd., 2748 37th Avenue N.E., Calgary, Alberta, T1Y 5Y3, Canada

[21] Appl. No.: 556,442

[22] Filed: Jul. 24, 1990

[51] Int. Cl.[5] ..... H04S 5/00

[52] U.S. Cl. ..... 381/17

[58] Field of Search ..... 381/1, 17, 24

[56] References Cited

U.S. PATENT DOCUMENTS 4,706,287 11/1987 Blackmer et al. ..... 381/17

FOREIGN PATENT DOCUMENTS 942459 11/1963 United Kingdom .
1512059 2/1968 France .
58-190199 11/1983 Japan .

*Primary Examiner*—Forester W. Isen

*Attorney, Agent, or Firm*—Lewis H. Eslinger; Jay H. Maioli

[57] ABSTRACT

In a sound image placement system, which provides sound image placement by processing a monaural input signal to produce two signals that have a phase and amplitude differential therebetween on a frequency dependent basis and that are fed to respective loudspeakers, an off-axis listening location can be obtained by producing an incoherent multiple of the monaural input signal, processing the incoherent signal to produce two signals with a different phase shift and amplitude alteration differential and then adding these two signals to the two signals produced from the original monaural input signal. The combined signals are played back simultaneously through the two loudspeakers. Each incoherent multiple of the monaural input signal can be processed to provide a different off-axis listening locale relative to a center axis of the two loudspeakers, with each off-axis listening locale resulting in the same sound image placement. Even though multiple signals are fed simultaneously to the two loudspeakers, by reason of their mutual incoherence the listener does not perceive any sound anomalies.

14 Claims, 7 Drawing Sheets

METHOD AND APPARATUS FOR GENERATING INCOHERENT MULTIPLES OF A MONAURAL INPUT SIGNAL FOR SOUND IMAGE PLACEMENT

BACKGROUND OF THE INVENTION

1. Field of the Invention

This invention relates generally to sound image placement and, more particularly, to a method and apparatus for producing a specific sound image placement that is independent of the location of the listener relative to the center axis of the loudspeakers.

2. Description of the Background

There have been numerous systems proposed for improving stereo imaging and for creating the impression in the listener that reproduced audio sounds are emanating from various locations within the listening space. Some systems provide reverberation and time delay effects in order to give the listener the feeling that the sounds are being produced within a large concert hall, for example. One system that has been proposed provides for a sound image to be located at points outside of the actual locations of the two transducers playing back the audio signals; such system is disclosed in U S. patent Ser. No. 239,981 filed Sept. 2, 1988 and assigned to the assignee hereof. This system teaches that a monaural signal may be divided into two signals and those two signals processed in such a fashion that a predetermined phase shift and amplitude alteration differential on a frequency dependent basis exists between these two signals. Upon proper application of this technology, a phantom sound image can be achieved that appears to the listener to be independent of the actual location of the two transducers.

While that system is generally successful in achieving the phantom sound imaging, the listener must generally be somewhere along a center line extending from the two speakers. There is some latitude in this position requirement, of course, yet that latitude does not extend across the entire area in front of the speakers.

Therefore, it has been desired to produce a sound imaging system that is not localized in its effects and in which a single listener or multiple listeners can be ranged across the front of the two speakers at several locations yet still all perceive a similar phantom sound image location.

OBJECTS AND SUMMARY OF THE INVENTION

Accordingly, it is an object to the present invention to provide a method and apparatus producing a phantom sound image that can eliminate the above-noted defects inherent in previously proposed systems.

Another object of this invention is to provide a method and apparatus for generating incoherent multiples of a monaural input signal and process those signals, so that a phantom sound image will be apparent at several off-axis locations ranged in front of two loudspeakers.

In accordance with an aspect of the present invention, the apparent phantom sound image location can be achieved at various points in front of two loudspeakers by first providing incoherent multiples of a monaural input signal The present invention realizes that by using incoherent multiples of a single input signal a number of "off-axis" transfer functions producing the same phantom image location relative to two loudspeakers can exist simultaneously and can go unnoticed by listeners at different axial listening locations relative to the loudspeakers. In this fashion, a number of listening axes can be generated by using a corresponding number of sound processors that provide respective transfer functions based upon amplitude alteration and phase shift on a frequency dependent basis. Each axis then permits the listener along that line to perceive the phantom sound image at a location that is similar to the location perceived by an on-axis listener.

This is accomplished by processing the signal in accordance with the above-identified patent application on the one hand and, on the other hand, by processing the signal through an incoherence transfer function and then subsequently through a process employing the above-described transfer function involving amplitude alteration and phase shift on a frequency dependent basis across the audio spectrum.

The subject of coherency is known in several contexts and in this instance the principal relevance is to human hearing and to audio signal processing. Generally speaking, coherence is defined as a relationship between two signals that can describe the similarity that exists between those two signals. Normalized cross-correlation of two signals is used as the measure of coherence, and perfectly coherent signals have a value of 1.0, while incoherent signals have a value of 0.0. In the case of coherent signals a value of 1.0 indicates that the two signals are identical and that amount of cross-correlation is generally referred to as autocorrelation. Of course, when the cross-correlation value is 0.0 the two signals seem to have no similarity whatsoever. The values of normalized cross-correlation lying between 0.0 and 1.0 then provide a measure of similarity between the two signals.

When determining correlation, the similarity is based upon the frequency content of the two signals, so that if a given frequency is present in both signals then this frequency will contribute to a nonzero value of the cross-correlation function. Coherence or cross-correlation describes the state of the two signals at a given point in time. Thus, if the time alignment of the two signals is altered, that is, if one signal is made to lag the other, then the correlation value will change. It is then seen that the cross-correlation function is based upon a large number of coherency measurements calculated at different time alignments The cross-correlation of two signals describes the similarity of frequency content of two signals as a function of time.

Various factors can be introduced to alter the degree of coherence between two signals and, as indicated above one, of such factors is time delay. In addition, if one of the signals is reduced in amplitude, for example by one half, and there is no time delay between the two signals then a maximum correlation of 0.5 will occur at a time lag of 0 in the cross-correlation function. If one of the signals is delayed in time and then the procedure repeated a maximum correlation of 1.0 will occur at a time lag equal to the delay that is introduced. In other words the frequency content is the same except for a time delay between the signals.

If in addition to the amplitude reduction of one-half a time delay is introduced as well, then the maximum the cross correlation function will be is 0.5 at a time lag equal to that delay.

The present invention utilizes cross-correlation measurement to aid in the design of various degrees of incoherence in multiple signals that can be reproduced by two loudspeakers, such that a sound image location can be produced at various locations that are off-axis relative to the two loudspeakers used to reproduce the audio program.

As noted above, coherence between signals is a function of the time alignment of the two signals, the amplitude differences between the two signals, the frequency content of the two signals, and the phase and amplitude difference for frequencies that are common between the two signals It must be noted, however, that the above-mentioned coherency criteria are valid when the differences between the signals are linear. Nonlinear differences can not be treated with the standard cross-correlation techniques. An example of nonlinear signals would be when one signal is compressed or expanded in time relative to the other signal.

The present invention recognizes further that the resolution of the human auditory system is quite precise. Thus, a listener will be able to distinguish the appropriate signal from among several incoherent signals being produced by the loudspeakers simultaneously. An example of this precise resolution of the human hearing system is found in the so-called "cocktail party" effect. In this situation it has been found that a person can focus on a single sound source in an environment in which there are many sound sources present at the same time. This resolution function is also connected to the binaural hearing phenomenon in which the two ears of the listener are employed to obtain the direction of the sound being perceived. It is known that if one ear is occluded, for example, the ability to focus on a desired sound source is reduced and may be lost altogether. Thus, the present invention recognizes that coherence between the two input ear signals is involved in the so-called cocktail party effect. In addition, when a listener is in a highly reverberant environment, binaural hearing can suppress most of the reverberant energy and allow the listener to focus on the direct sound waves. This is similar to the ability of the human auditory system to recognize a sound source that is immersed in noise. It can be shown that binaural human hearing can detect human speech mixed with sound when it is as much as 30 decibels below the level of random noise, however, if only one ear is employed, then the speech must be no more than 5 decibels lower than the random noise. Therefore, the present invention determines that binaural coherence is important in this type of signal detection.

In addition, the present inventive system that provides off-axis listening locales also is applicable to sound positioning systems that operate differently than the system of the above-identified pending patent application. The incoherency principle that is recognized by the present invention can be applied to sound imaging systems that employ cross-talk cancelling, reverberation, and phase-shift, for example.

The above and other objects, features, and advantages of the present invention will become apparent from the following detailed description of illustrated embodiments thereof, to be read in conjunction with the accompanying drawings in which like reference numerals represent the same or similar elements.

DETAILED DESCRIPTION OF PREFERRED EMBODIMENT

Figure 1:
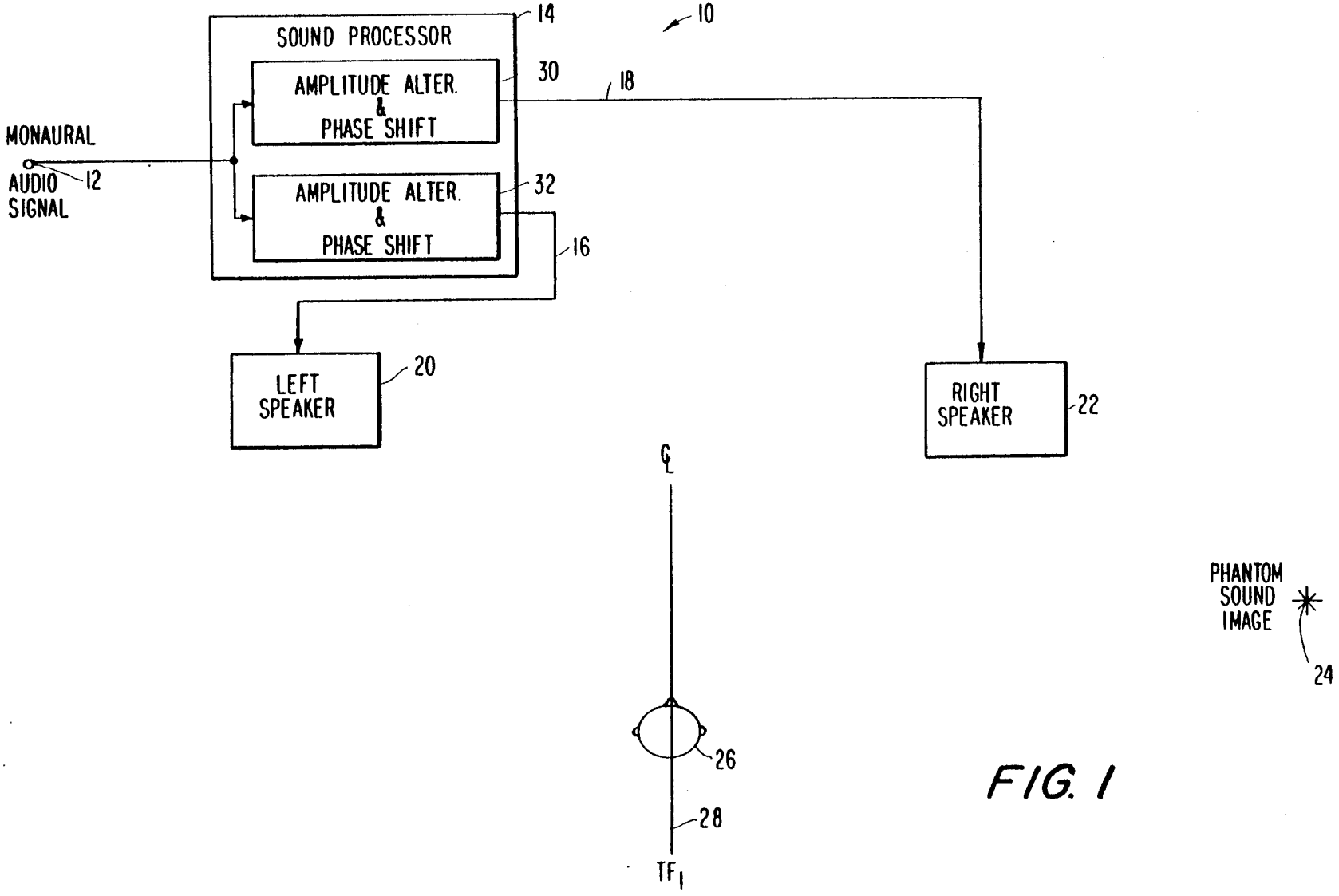
FIG. 1 is a block diagram representation of a sound image placement system previously proposed.

FIG. 1 shows a sound image processing system 10 as proposed in the above-identified patent application in which a monaural audio signal is fed in at input terminal 12 to a sound processor 14 that produces two output signals on lines 16 and 18, respectively, which may be thought of as being left and right signals. These signals on lines 16 and 18 are fed to loudspeakers 20 and 22, respectively. Although it is convenient to refer to these loudspeakers as left and right as employed in the reproduction of stereophonic sound, in fact, unlike conventional stereo upon choosing the appropriate frequency dependent transfer function in sound processor 14 a phantom sound image, as represented at location 24, can be achieved relative to a listener 26 located in the vicinity of an on-axis center line 28. More specifically, sound processor 14 generally contains a filter or the like that provides a predetermined frequency dependent basis between two signals that are derived from the single signal input at terminal 12. This differential is produced by the amplitude alteration and phase shift units 30 and 32 that form sound processor 14. The amplitude is altered and the phase shifted separately and independently for a number of frequency bands across the audio spectrum. It is understood that upon such suitable amplitude alteration and phase shifting on a frequency dependent basis that the phantom sound image can be placed at various locations in the listening space in addition to the one shown at 24 in FIG. 1. These amplitude alterations and phase shifts on a frequency dependent basis may be thought of as providing a first transfer function. Thus, upon generating the two signals on lines 16 and 18 in accordance with this first transfer function and feeding the signals to loudspeakers 20 and 22, a listener 26 who is arranged in the vicinity of the on-axis center line 28 relative to loudspeakers 20, 22 will perceive that the sounds he is hearing are emanating from location 24. Nevertheless, upon migrating to the left or right of center axis 28 the listener 26 will lose some of this apparent sound image location and ultimately the sound will appear to listener 26 to be simply emanating from loudspeakers 20 and 22.

Figure 2:
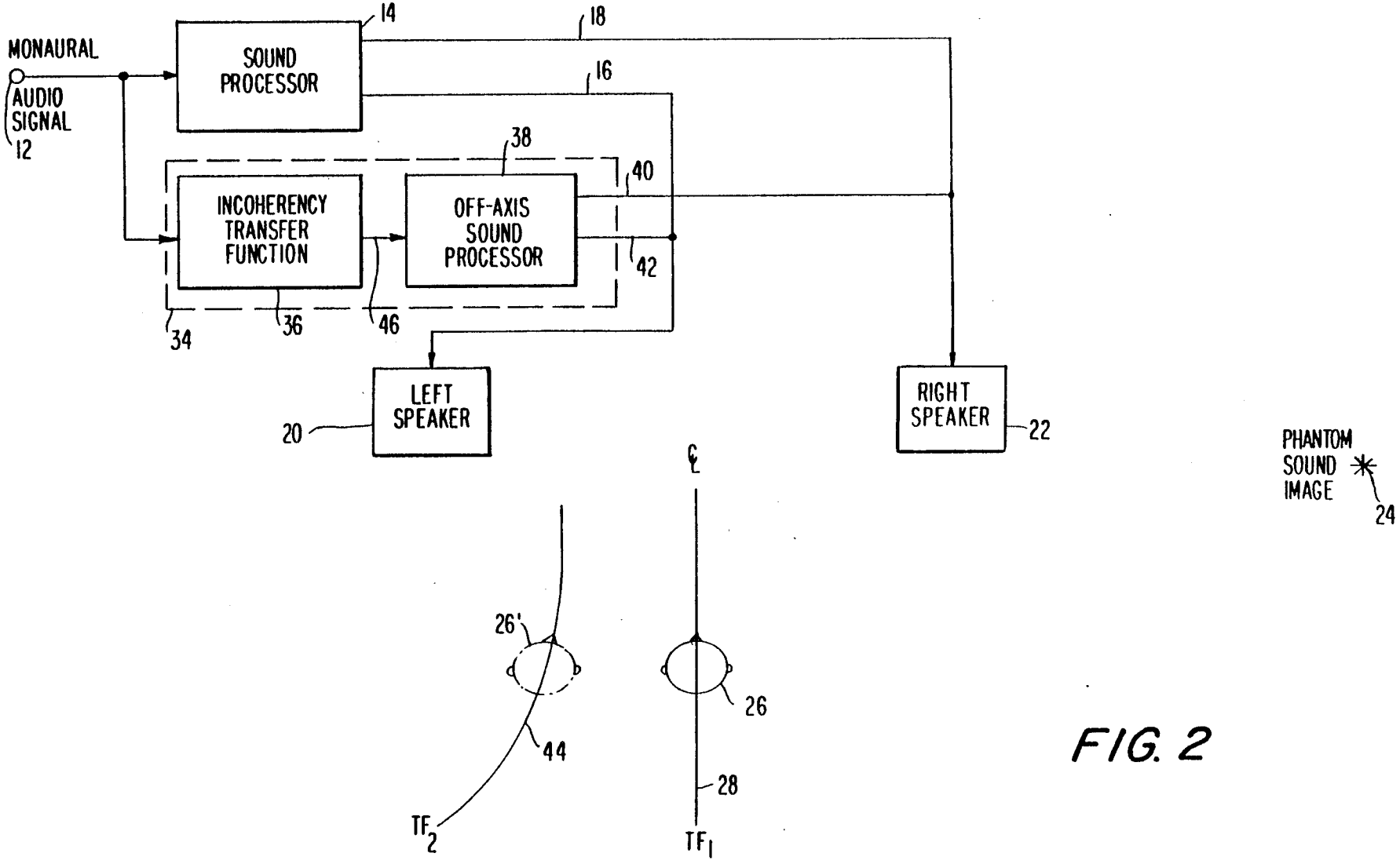
FIG. 2 is a block diagram representation of a sound image placement system according to an embodiment of the present invention.

Turning then to FIG. 2, the system of FIG. 1 is modified in accordance with an embodiment of the present invention to achieve off-axis sound imaging, as well as an on-axis sound imaging. Specifically, the monaural input signal at 12 is also fed to an incoherent sound processing unit 34 where the input signal is passed through an incoherency transfer function unit 36 to produce a second signal that is an incoherent multiple of the signal input at terminal 12. More particularly, the input signal is applied to the inventive incoherent sound processing unit 34 that includes incoherency transfer function unit 36 and an off-axis sound processor 38. The outputs of incoherent sound processing unit 34 on lines 40 and 42 are then superimposed directly on the outputs of sound processor 14 on lines 16 and 18, respectively. Sound processor 14 is the same sound processor with the first transfer function as described above with regard to FIG. 1, provided that the phantom sound image is to remain at 24. Off-axis sound processor 38 can include a unit like sound processor 14, however, its transfer function may be different, because the location of the phantom sound image 24 is different relative to off-axis 44 than it is to axis 28.

There are numerous approaches to producing an incoherent signal from a monaural input signal and one such approach might be simply to apply incoherency to the input signal. Thus, the signal on line 46 can be the same as the signal at input 12 but with random ripple introduced. Other simple approaches to providing incoherency might be to change the amplitude of the signal envelope or to change the time alignment, that is, apply a time delay to the input signal. Incoherency could also be produced by applying both an amplitude change and a time delay to the input signal. Incoherency may also be accomplished by employing a simple filter so that the entire length of the signal is processed using the same filter, which could be either a high or low-pass filter of constant slope. The filter also could have a constant phase shift or it could be a simple notch filter, or it could be a filter with amplitude or frequency modulation performed by a sine wave, or a filter with phase modulation in response to a sine wave. Other modulation waveforms could also be employed. Still more complex ways of achieving the desired incoherency would be to combine both amplitude and phase modulation in a filter or to adjust the amplitude and/or the phase of the filter with random values, that is, a random dither signal. As is known, the above-described filter characteristics could be accomplished employing a finite impulse response (FIR) filter over the entire length of the signal.

There are even more complex approaches to accomplishing the desired incoherency between two signals. For example, relative to the above-described FIR filter approach, modulation of the filter amplitude using a sine wave could be employed with the frequency of the modulating sine wave being changed at intervals as small as one millisecond Similarly, the sine wave modulation of the amplitude of the filter response could be periodically changed to modulate the phase of the filter response at a different modulation frequency, with a notch filter being employed so that the nature of the incoherency filter varies over the length of the signal. In addition, the signal could be processed so that it is expanded or compressed in time, at regular intervals or at irregular intervals. So too, the start and end points of the compression/expansion process could be chosen at random or at regular intervals. Finally, the various filtering approaches could be combined with a compression/expansion process, so that the compressed/expanded version of the signal is processed with one of the above-described incoherency filters.

It is noted that this last alternative is perhaps most similar to naturally occurring incoherence, because it is essentially impossible for a person to perform the same musical part twice in the exact same manner and, thus, there will be subtle differences in timing, loudness, pitch, and so on between the two performances, which will be mutually incoherent. It is interesting to note further that the human auditory system can easily detect such differences between performances, because there is a great deal of learning that has gone into developing each person's auditory system.

Whatever approach is chosen to produce the incoherent multiple signal from the monaural audio signal input at terminal 12, the signal on line 46 is fed to off-axis sound processor 38 that is similar to sound processor 14, however, the actual transfer function embodied as the amplitude alteration and phase shift differential on a frequency dependent basis is different. The difference in transfer function can be empirically determined in view of the fact that the actual location of the phantom sound image 24 will be at a somewhat different relative location when the listening position moves off the center axis 28 of loudspeakers 20 and 22. More specifically, in this embodiment of FIG. 2 it is desired to provide only one off-axis listening location along axis 44, so that a listener 26' arranged thereon would still perceive the phantom sound image to be emanating from location 24. Thus, axis 44 that has associated with a transfer function $TF_2$, as might be produced by incoherent sound processing unit 34, will result in listener 26' therealong perceiving a phantom sound image at location 24.

Figure 3:
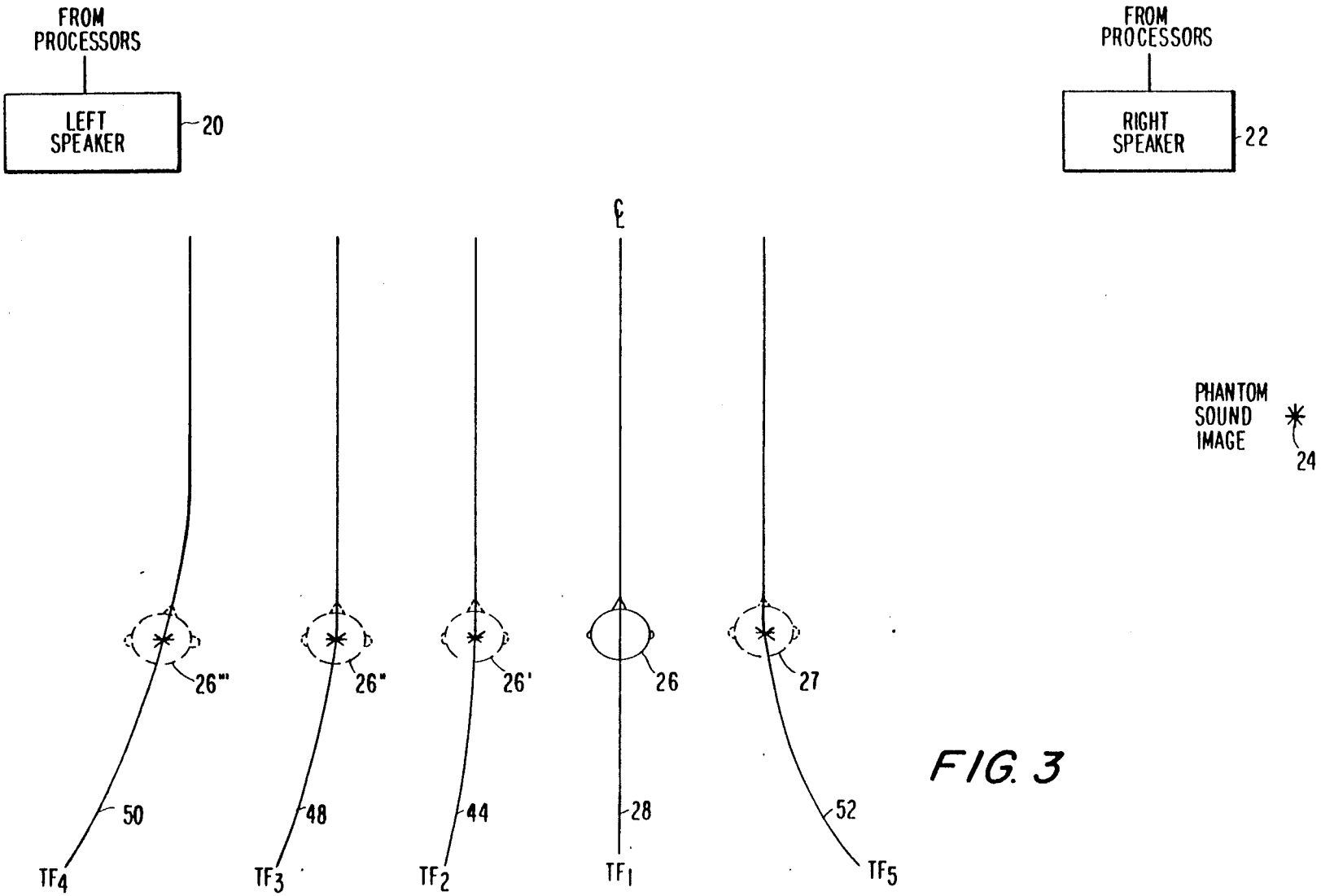
FIG. 3 is a diagrammatic representation of several off-axis listening locations that can be produced according to an embodiment of the present invention.

FIG. 2 shows only a single additional off-axis listening locale, however, the present invention contemplates the provision of several off-axis sites on both sides of the center axis and this desired result is represented in FIG. 3. As shown therein, the same two loudspeakers 20 and 22 are employed and the processors that feed the signals thereto will be shown in FIG. 4. As represented in FIG. 3, four different off-axis listening locations are provided following the present invention by generating incoherent multiples from a monaural input signal and then processing each signal simultaneously over two loudspeakers Specifically, a first left off-axis 44 corresponds to that shown in FIG. 2, with subsequent left off-axes 48 and 50 moving further to the left of center. Off-axis listening can also be provided to the right of center axis 28 and axis 52 permits a listener 27 located therealong to also sense phantom sound image 24, upon suitable processing as will be explained. Upon listeners assuming the positions shown at 26', 26'', 26''', and 27, the sound image will still appear to be emanating from phantom location 24. The processing system employed to produce these off-axis listening locations is shown generally in FIG. 4.

Figure 4:
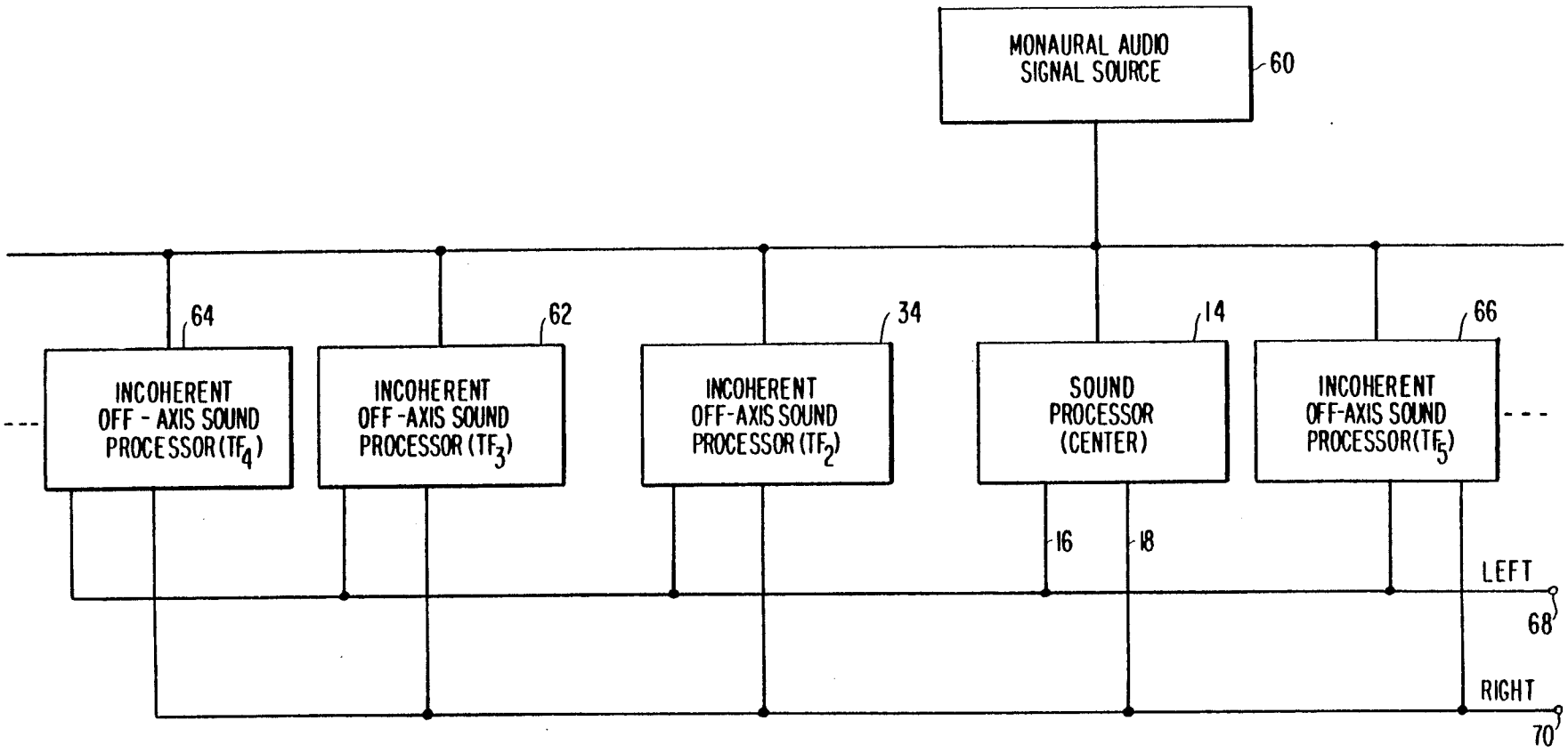
FIG. 4 is a block diagram showing a system according to embodiment of the present invention that can produce the several off-axis listening locations shown in FIG. 3.

Turning then to FIG. 4, a monaural audio signal source 60 is provided that produces a signal fed to sound processor 14, which is the same as shown in FIGS. 1 and 2, for example. This produces a center axis listening location. In addition, an incoherent off-axis sound processor unit such as 34 in FIG. 2 is provided for a first left off-axis processing, such as represented at axis 44 in FIGS. 2 and 3. A second left off-axis listening locale is provided by incoherent off-axis sound processor 62 that contains a different transfer function ($TF_3$) than either units 14 or 34. Incoherent sound processor 62 receives the signal from source 60, renders an incoherent version of it and than processes that signal into two output signals, so that listener 26" in FIG. 3 located along off-axis 48 will perceive a phantom sound image at the same location 24 at the center axis. As indicated above, numerous off axes can be produced and an incoherent off-axis sound processor 64 will produce an off-axis listening locale to the far left of center axis 28 and incoherent off-axis sound processor 66 will produce an off-axis sound location 52 to the right of center axis 28. All of the sound processors 14, 34, and 62–66 have their outputs superimposed and connected in common to left and right output terminals 68, 70, which are connected directly to the left and right loudspeakers 20 and 22, respectively. It will be appreciated that any number of incoherent sound processors can be assembled in the system based upon the size and/or dimensions of the listening area.

Figure 5:
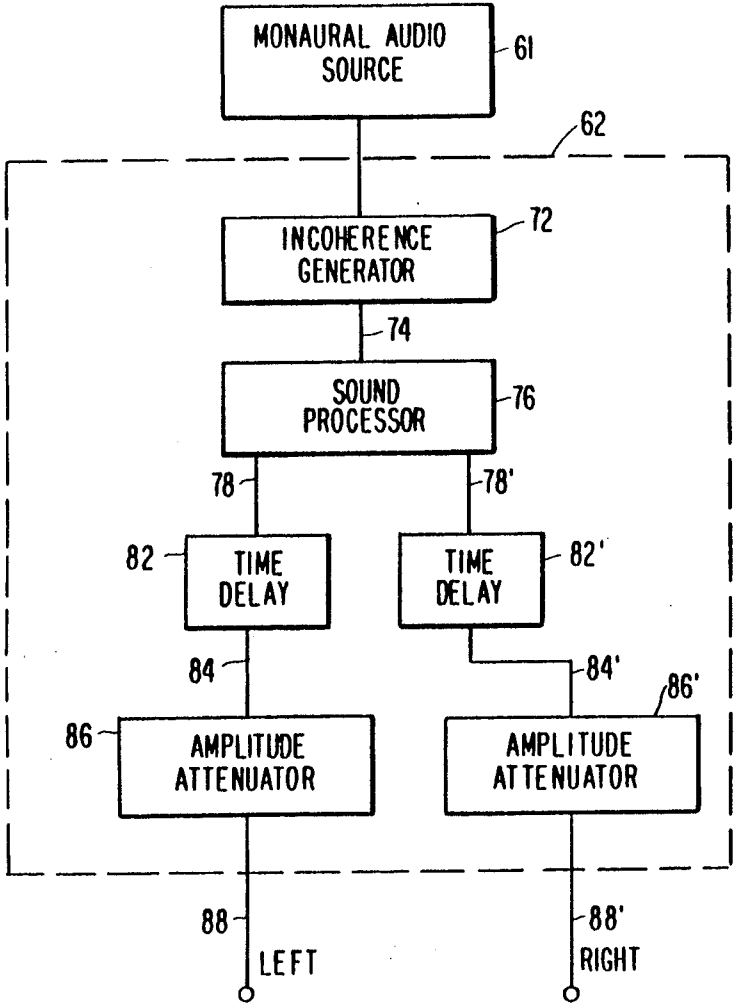
FIG. 5 is a block diagram showing an incoherent sound processor used in the embodiment of FIG. 4.

One of the incoherent off-axis sound processors 34 or 62–66 of FIG. 4 is shown in more detail in FIG. 5, within dashed lines 60 in which monaural source 61 produces a signal fed to an incoherence generator 72 that might introduce random ripple or random dither to the signal, for example. As noted above, however, incoherence generator 72 could also be a complex unit that could provide incoherence by controlled modulation shifts or the like. The generated incoherent multiple signal on line 74 from incoherence generator 72 is fed to a sound processor 76 that includes generally the same amplitude alteration and phase shifting devices as shown in sound processor 14 of FIG. 1 to provide the sound image placement, at 24 in FIG. 3, for example. Accordingly, as has been pointed out above, sound processor 76 produces what may be thought of as left and right output signals from a single monaural input signal, which here is an incoherent signal relative to the audio input signal, and which output signals have a predetermined phase and amplitude differential therebetween on a frequency dependent basis In this case, one output signal on line 78 becomes the left output signal and the other output signal on line 78' becomes the right output signal. These two signals are fed respectively to time delay units 82, 82' for producing time delayed signals on lines 84, 84' that are fed to amplitude altering circuits 86, 86' that further alter the amplitudes of the two signals. The thus processed incoherent time delayed and amplitude altered signals on lines 88, 88') are then so-called left and right output signals respectively.

Time delay units 82, 82' and amplitude attenuators 86, 86' provide the further processing that moves the listening position off-axis, while retaining the sound placement image at 24, for example. In keeping with the present invention, the original shape of the center or on-axis transfer function can be retained but it can be shifted in time and amplitude.

Although a time delay and amplitude attenuator is provided in each output leg from the sound processor in FIG. 5, the present invention is equally applicable to providing one output directly from the sound processor and providing time delay and amplitude attenuation in one output leg only. In addition, it is possible to embody the entire incoherent off-axis sound processor in one programmable digital filter.

Figure 6A:
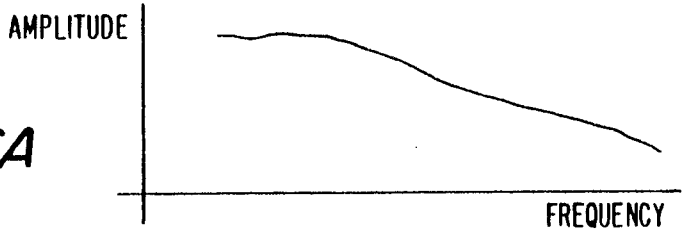
FIGS. 6A and 6B are graphical representations of one example of how simple incoherence is used to process an input signal.
Figure 6B:
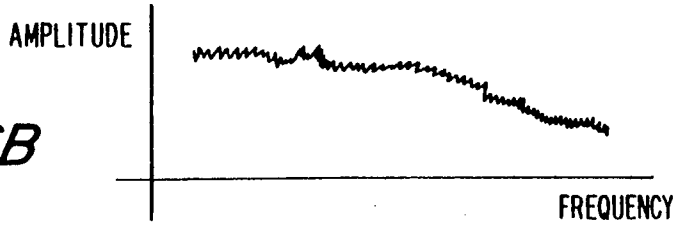

FIG. 6B shows the output signal as might be produced on line 74 with the incoherence being represented as random amplitude ripple inserted in the signal of FIG. 6A.

Figure 6C:
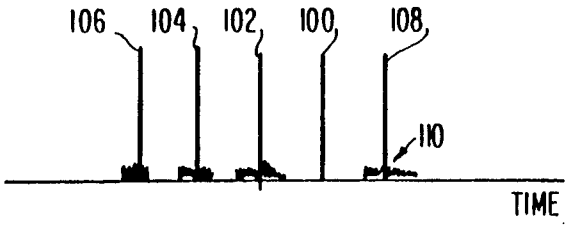
FIG. 6C is a graphic representation of a filter response for the system of FIG. 4.

As another example, FIG. 6C represents a combined output of FIG. 4 using a finite impulse response filter (FIR) showing the five listening positions. Specifically, the output of sound processor 14 is represented by the signal 100, whereas the outputs of the incoherent off-axis sound processors 34 and 62–66 lie on either side thereof at 102, 104, 106, and 108, respectively. The incoherency that has been added by the incoherency generators shows up in the output of the FIR filter as so-called hash or small amplitude signals on either side of the principal frequency, as represented at 110 relative to output 108 of FIG. 6C. Note that each of the incoherent sound processor outputs has this incoherency, whereas the center axis sound processor 14 does not. This kind of amplitude ripple may not be necessary if time expansion is used, since the net result there is a similar incoherency in the amplitude.

Figure 7:
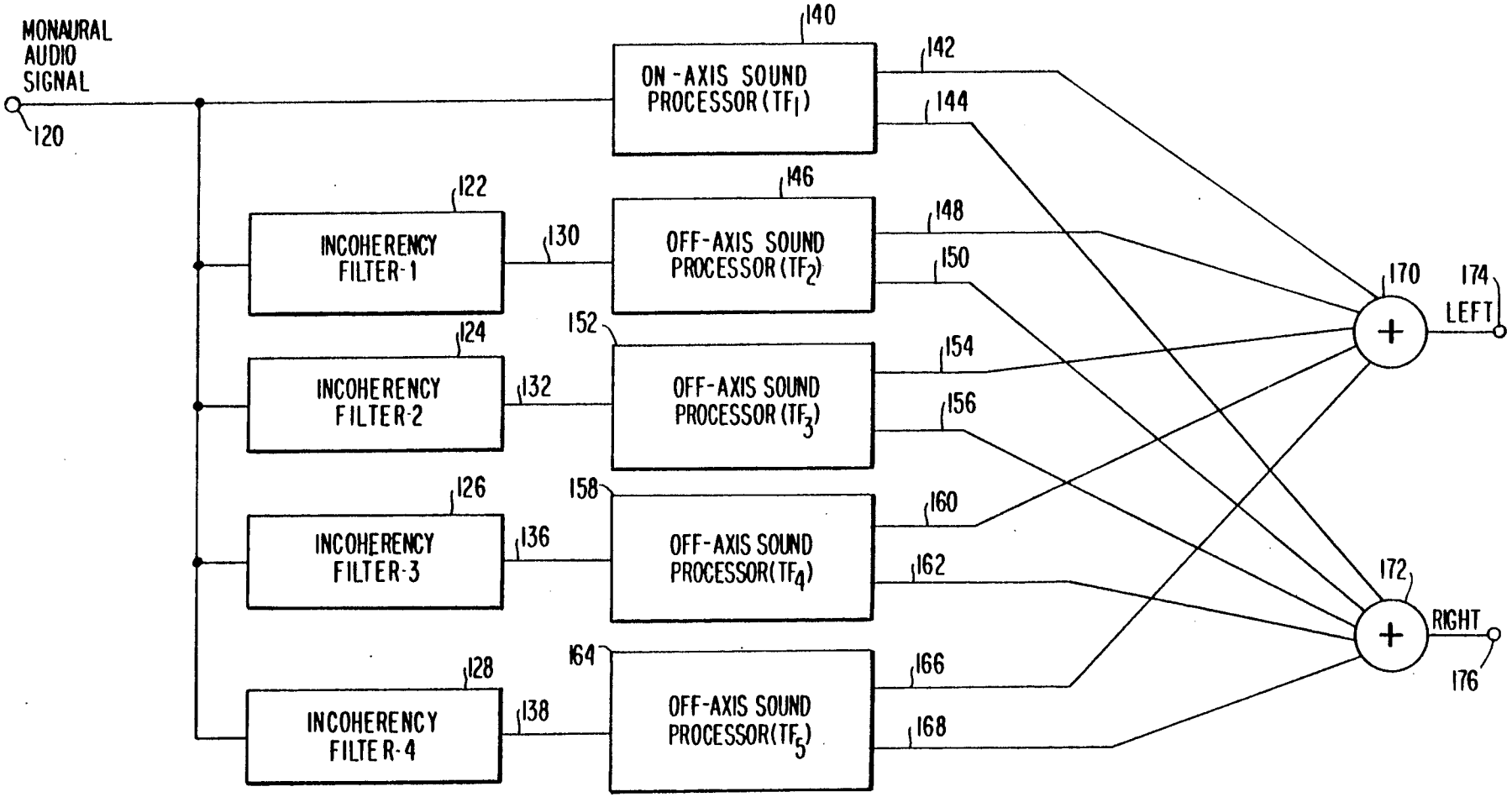
FIG. 7 is a block diagram showing a sound processing system producing off-axis listening locations according to another embodiment of the present invention.

A modified embodiment of the present invention is shown in FIG. 7, in which the incoherence generators, such as 72 in FIG. 5, for the off-axis listening locales are each provided by separate FIR filters The on-axis sound processor is similar to processor 14 of FIG. 1 and produces the desired differential phase shift and amplitude alteration on a frequency dependent basis between two output signals derived from a single monaural input signal. More specifically, a monaural audio signal is fed in at input terminal 120 to a number of incoherency filters 122, 124, 126, and 128, with each filter producing a respective output signal on lines 130, 132, 136, and 138, that is mutually incoherent relative to the other signals Each of these signals will then be processed to achieve the off-axis listening locale that results in the same phantom sound image location. The input signal at terminal 120 is also fed directly to an on-axis sound processor 140 that includes an amplitude altering and phase shifting circuit or filter, so that its output signals on line 142 and 144 have a predetermined phase shift and amplitude alteration differential on a frequency dependent basis. Thus, a first transfer function ($TF_1$) is provided corresponding to perceiving the desired phantom sound image along an on-axis listening locale. On the other hand, the output of the first incoherency filter 122 on line 130 is fed to a an off-axis sound processor 146 that has a still different transfer function ($TF_2$) to produce a differential amplitude and phase differential between its two output signals on lines 148 and 150. The output from the second incoherency filter 124 on line 132 is fed to a second off-axis sound processor 152 that has yet a different transfer function relative to an amplitude and phase differential between its output signals on lines 154 and 156. The output of third incoherency filter 126 on line 136 is fed to a third off-axis sound processor 158 that has a different transfer function ($TF_4$) to produce the differential phase and amplitude relationship between its output signals on lines 160 and 162.

The output of fourth incoherency filter 128 on line 138 is fed to a fourth off-axis sound processor 164 that has yet a different transfer function ($TF_5$) so that a predetermined differential phase and amplitude relationship exists between its output signals on lines 166 and 168.

As represented generally in FIG. 4, all of these input signals are superimposed into final left and right output signals and that is accomplished in the embodiment of FIG. 7 by using signal adders 170 and 172. Specifically, adder 170 combines the signals on lines 142, 148, 154, 160, and 166 to produce the so-called left channel output at terminal 174. On the other hand, the signals on lines 144, 150, 156, 162, and 168 are summed in adder 172 to produce the so-called right output channel terminal 176. As will be explained it is contemplated by the present invention that the outputs of the off-axis processors may be modulated before being fed to the adders.

Operation of the embodiment shown in FIG. 7 will result in three off-axis listening axes to the left of the center axis, as shown in FIG. 3 as well as one off-axis listening site to the right of the center axis.

In this embodiment only five different listening axes are provided so there are only four incoherency filters, however, any number of incoherency filters and associated off-axis sound processors could be provided.

Because various listening configurations can be envisioned, the provision of all of these processors in a signal unit can be achieved and advantageously employed utilizing switches so that some of the processors can be turned off as desired. In addition, as will be noted from the embodiment in FIG. 7, for example, a number of processed signals are being summed so that there could be an increase or energy accumulation at the output.

Accordingly, the sound processors can be scaled or can be modulated so that some processors are turned off periodically to prevent undue energy accumulation. This turning off or modulation may be sort of analogous to the situation in viewing a motion picture film, in which although the picture appears to be moving in fact the picture is actually made up of a lot of stationary frames but the eye is not fast enough to detect the changes between the stationary frames. This scaling need not involve turning the several signals off and on, which might result in audible clicks and pops, and can be advantageously achieved by making a sequence of amplitude adjustments. That is, a fixed sequence of volume adjustments at selected locations in the signal path of each off-axis processed signal in order to prevent excessive signal levels at the outputs when all the off-axis and on-axis signals are combined.

Figure 8:
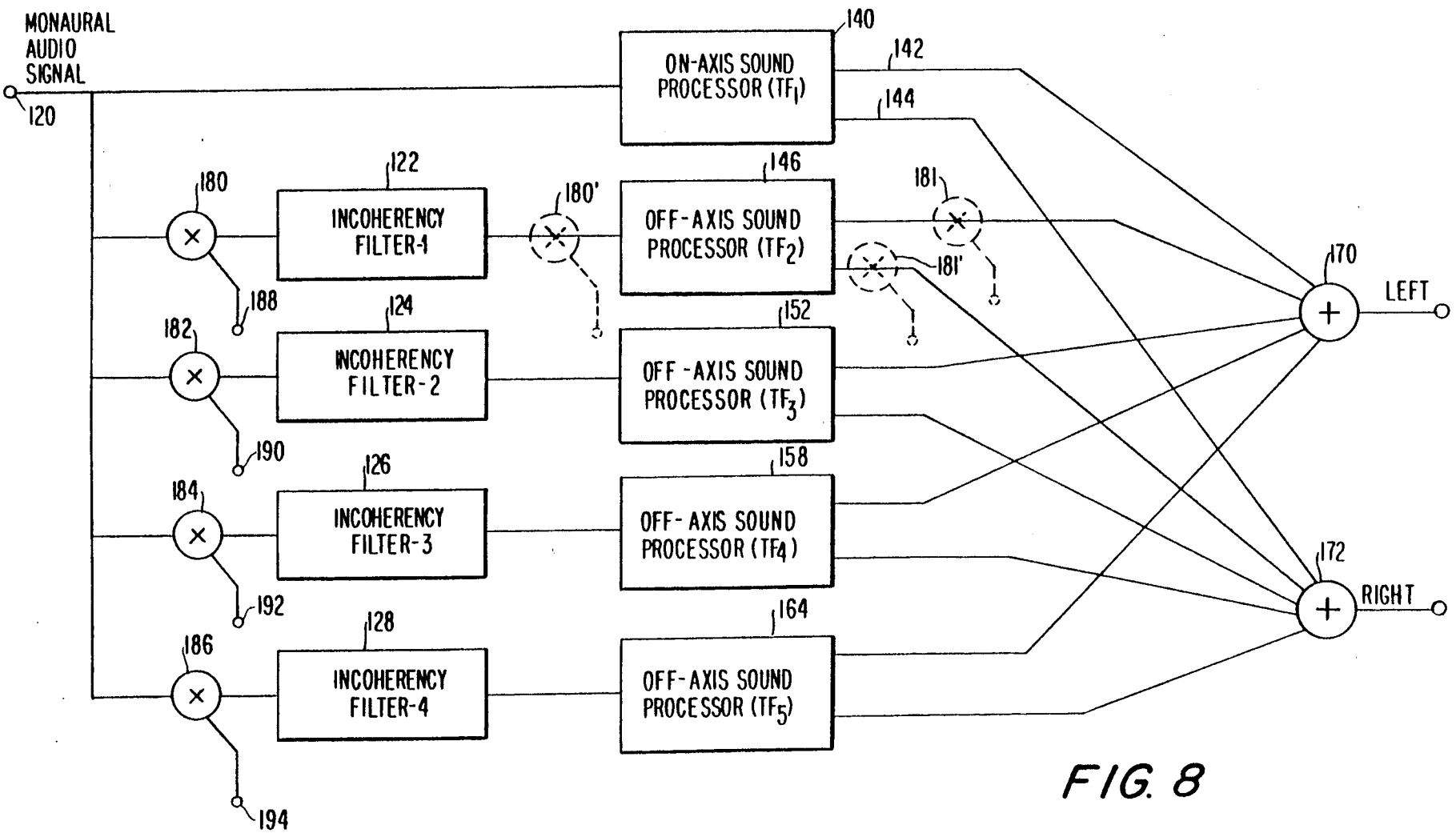
FIG. 8 is a block diagram of a sound processing system similar to that of FIG. 7, in which scaling is provided.

FIG. 8 shows one approach to providing volume adjustments to the off-axis signals installed on a system similar to that of FIG. 7. In the system of FIG. 8, a variable amplitude attenuator 180, 182, 184, 186 is inserted in the input line to each incoherency filter 122, 124, 126, 128, respectively. Each individual amplitude attenuator is separately controllable by a respective control signal at input 188, 190, 192, 194. These signals may be derived from a microprocessor or any other programmable control system already employed in the audio processing system. For example, the control used or the FIR's embodying the various sound processors. With this embodiment it is an easy matter to control the relative signal levels in the off-axis processing channels.

In performing this signal scaling or sequential volume adjustment, the location in the signal path of the controllable attenuator is not critical. Thus, in place of attenuator 180 at the input of incoherency filter 122 it could just as well be located at the output thereof, as shown in phantom at 180'. Similarly, a controllable volume adjustor could be connected in one output line of an off-axis processor, as shown in phantom at 181 or a controllable volume adjustor could be connected in both output lines of an off-axis processor, such as shown in phantom at 181 and 181'.

It is understood, of course, that the various locations for the controllable attenuators as described above apply equally for every off-axis sound processing channel, and the first channel is shown only in FIG. 8 in the interest of clarity and brevity.

Although the left and right output signals have been shown fed to two transducers, these signals could just as well be fed to any multitrack storage medium. The stored signals could then be played back at a later time and used to generate multiple copies, for example.

It is understood of course, that the above is presented by way of example only and is not intended to limit the scope of the present invention, except as set forth in the appended claims.

What is claimed is:

1. An audio signal processing system for producing a listener-perceived sound emanating location that is different than an actual location of either of two loudspeakers and is independent of listener alignment relative to a center axis extending outwardly from between the two loudspeakers, comprising:

means for receiving a monaural audio input signal;

first means for processing said monaural audio input signal and producing a first pair of output signals having a predetermined phase shift and amplitude alteration differential therebetween on a frequency dependent basis in accordance with a first predetermined transfer function, said predetermined phase and amplitude differential producing the perceived sound emanating location in a listener located along said center axis upon applying said first pair of output signals to respective ones of the two loudspeakers;

incoherency means for producing an incoherent signal from the monaural audio input signal;

second means for processing the incoherent signal from said incoherency means and producing a second pair of output signals having a second predetermined phase shift amplitude alteration differential therebetween on a frequency dependent basis in accordance with a second predetermined transfer function, said second predetermined phase and amplitude differential producing the perceived sound emanating location in a listener located along a second axis substantially parallel to and spaced-apart from said center axis upon applying said second pair of output signals to respective ones of the two loudspeakers; and means for superimposing respective ones of said first pair of output signals and said second pair of output signals to produce first and second combined signals fed to the two loudspeakers to produce an audio image to a listener located along said center axis and to a listener located along said second axis that a sound source is located at said sound emanating location.

2. An audio signal processing system according to claim 1, wherein said second means for processing the incoherent signal includes at least one time delay circuit and at least one amplitude attenuating element for time delaying and amplitude attenuating one of said secodn pair of output signals.

3. An audio signal processing system according to claim 1, further comprising:

second incoherency means for producing a second incoherent signal from the monaural audio input signal; and third means for processing said second incoherency signal from said second incoherency means and producing a third pair of output signals having a third predetermined phase shift and amplitude alteration differential therebetween on a frequency dependent basis in accordance with a third transfer function, said predetermined phase and amplitude differential producing the perceived sound emanating location to a listener located along a third axis substantially parallel to and spaced-apart from said first axis and located on a side thereof opposite said second axis; and means for supplying said third pair of output signals to said means for superimposing, whereby said means for superimposing simultaneously combines respective ones of said first, second, and third pairs of output signals to produce a pair of combined signals fed to the two loudspeakers, respectively.

4. An audio signal processing system according to claim 1, further comprising a controllable signal attenuator receiving said monaural audio input signal and producing a selectively attenuated monaural audio input signal fed to said incoherency means, whereby said incoherency means produces an attenuated incoherent signal therefrom fed to said second means for processing.

5. An audio signal processing system according to claim 1, further comprising a controllable signal attenuator receiving said incoherent signal from said incoherency means and producing a selectively attenuated incoherent signal fed to said second means for processing.

6. An audio signal processing system according to claim 1, further comprising a controllable signal attenuator connected to receive one of said pair of output signals from said second means for processing and producing an attenuated signal therefrom fed to said means for superimposing with a respective signal from said first means for processing.

7. An audio signal processing system according to claim 6, further comprising a second controllable signal attenuator connected to receive the other of said pair of output signals from said second means for processing and producing an attenuated signal therefrom fed to said means for superimposing for superimposing with a respective signal from said first means for processing.

8. An audio signal processing system for causing a listener to perceive that sound is emanating from a sound source at a location other than actual locations of two loudspeakers producing the sound, comprising:

input means for receiving a single audio signal;

incoherency means connected to said input means for producing therefrom a plurality of signals that are mutually incoherent and that are each incoherent relative to the single audio signal;

incoherent sound processing means for simultaneously processing each of said mutually incoherent signals and producing respective pairs of incoherent processed output signals, each pair of output signals having a respective predetermined phase shift and amplitude alteration on a frequency dependent basis in accordance with a respective transfer function corresponding to a respective listener location relative to a center axis extending outwardly from between the two loudspeakers;

sound processing means for processing said single audio signal from said input means and producing a pair of processed output signals having a predetermined phase shift and amplitude alteration differential on a frequency dependent basis in accordance with a predetermined transfer function corresponding to a listener location along said center axis; and means for combining respective ones of said pairs of incoherent processed output signals from said incoherent signal processing means and said pair of output signals from said sound processing means to produce first and second system output signals fed respectively to the two loudspeakers.

9. An audio signal processing system according to claim 8, wherein said incoherent sound processing means includes a time delay circuit and an amplitude attenuator connected in series in a signal path of each of said incoherent processed output signals.

10. An audio signal processing system according to claim 8, further comprising a plurality of controllable signal attenuators arranged to receive respective ones of said plurality of signals from said incoherency means for producing a plurality of attenuated, incoherent signals fed as inputs to said incoherent sound processing means.

11. An audio signal processing system according to claim 8, further comprising a plurality of controllable signal attenuators, each receiving said single audio signal from said input means and producing an attenuated audio signal therefrom, and wherein said incoherency means comprises a plurality of incoherency filters, each receiving an attenuated audio signal from a respective one of said plurality of signal attenuators and each producing a corresponding attenuated incoherent signal therefrom that are mutually incoherent and that are fed as inputs to said incoherency processing means.

12. An audio signal processing system according to claim 8, further comprising a plurality of controllable signal attenuators connected to receive one of each of said pairs of incoherent processed output signals from said incoherent sound processing means and each producing an attenuated signal therefrom fed to said means for combining.

13. An audio signal processing system according to claim 12, further comprising a second plurality of controllable signal attenuators connected to receive the other ones of said pairs of incoherent processed output signals from said incoherent sound processing means and each producing an attenuated signal therefrom fed to said means for combining.

14. An audio signal processing system according to claim 8, further comprising at least one controllable signal attenuator connected to receive one signal of at least one of said pairs of incoherent processed output signals from said incoherent processing means and producing an attenuated signal therefrom fed to said means for combining.

* * * * *

UNITED STATES PATENT AND TRADEMARK OFFICE

CERTIFICATE OF CORRECTION

PATENT NO. : 5,095,507

DATED : March 10, 1992

INVENTOR(S) : Danny D. Lowe

It is certified that error appears in the above-identified patent and that said Letters Patent is hereby corrected as shown below:

On the title page:

[76] Inventor: Danny D. Lowe, c/o "O Sound Ltd.," should be --Q Sound Ltd.,--

Signed and Sealed this

First Day of June, 1993

*Attest:*

Michael K. Kirk

MICHAEL K. KIRK

*Attesting Officer*

*Acting Commissioner of Patents and Trademarks*